US009388624B2

(12) United States Patent
Geesmeier et al.

(10) Patent No.: US 9,388,624 B2
(45) Date of Patent: Jul. 12, 2016

(54) CASH BOX WITH A HEIGHT LIMITER ENGAGING WITH THE RETAINING ELEMENT

(71) Applicant: Wincor Nixdorf International GmbH, Paderborn (DE)

(72) Inventors: Andreas Geesmeier, Bad Wuennenberg (DE); Peter Heimann, Salzkotten (DE); Ralf Welter, Paderborn (DE); Hans-Guenter Voss, Paderborn (DE); Dirk Langhuber, Paderborn (DE)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 14/633,534

(22) Filed: Feb. 27, 2015

(65) Prior Publication Data

US 2015/0247354 A1 Sep. 3, 2015

(30) Foreign Application Priority Data

Feb. 28, 2014 (EP) ..... 14157344

(51) Int. Cl.
*E05G 1/00* (2006.01)
*G07D 11/00* (2006.01)

(52) U.S. Cl.
CPC ..... *E05G 1/005* (2013.01); *G07D 11/0012* (2013.01)

(58) Field of Classification Search
CPC ..... E05G 1/005; G07D 11/0009; G07D 11/0012; G07D 11/0021; B65H 5/36; B65H 31/20; B65H 2701/1912; G07F 7/04; G07F 19/203; B65B 25/14
USPC ..... 232/1 D, 15, 16; 109/58; 902/13; 271/144, 171, 223, 264
See application file for complete search history.

(56) References Cited

U.S. PATENT DOCUMENTS

| | | | | |
|---|---|---|---|---|
| 7,766,316 | B2 | 8/2010 | Landwehr et al. | |
| 8,317,089 | B2 | 11/2012 | Brexel et al. | |
| 2009/0184458 | A1* | 7/2009 | Bisone | G07D 11/0012 271/10.09 |
| 2011/0042889 | A1* | 2/2011 | Holland-Letz | B65H 29/40 271/264 |
| 2011/0052363 | A1 | 3/2011 | Brexel et al. | |
| 2012/0067011 | A1 | 3/2012 | Holland-Letz et al. | |
| 2012/0167529 | A1 | 7/2012 | Langhuber et al. | |
| 2015/0027354 | A1* | 1/2015 | Berendes | E05G 1/005 109/25 |

FOREIGN PATENT DOCUMENTS

| | | | |
|---|---|---|---|
| DE | 102009058519 | A1 | 6/2011 |
| DE | 102012102223 | A1 | 9/2013 |
| WO | WO-2007/090899 | A1 | 8/2007 |

* cited by examiner

*Primary Examiner* — William Miller
(74) *Attorney, Agent, or Firm* — Harness, Dickey & Pierce, P.L.C.

(57) ABSTRACT

The invention relates to a cash box (10, 100, 102) comprising a receiving area (24) for receiving a value note stack and a first opening (18) for manually feeding and removing notes of value, which first opening is closable by a cover (16). On the cover (16), a height limiter (36) for adjusting the height of the receiving area (24) is provided, this height limiter (36) comprising at least one finger (40, 42) which, at least when the cover (16) is closed, projects into a recess (44, 46) of a retaining element (30).

15 Claims, 6 Drawing Sheets

CASH BOX WITH A HEIGHT LIMITER ENGAGING WITH THE RETAINING ELEMENT

CROSS REFERENCE TO RELATED APPLICATIONS

This application claims the benefit and priority of European Patent Application No. EP 14 157 344.4 filed Feb. 28, 2014. The entire disclosure of the above application is incorporated herein by reference.

BACKGROUND

1. Technical Field

The invention relates to a cash box comprising a receiving area for receiving a value note stack and a first opening for manually feeding and/or removing notes of value to and from the receiving area, respectively, which first opening is closable by a cover. Further, the cash box has a bottom unit which delimits the receiving area toward a box bottom and a retaining element which, in a retaining position, retains the notes of value received in the receiving area in said receiving area and which, in a feeding position, enables a feeding and/or removing of the notes of value through a second opening for the automatic feeding and/or removing of notes of value. On the cover, a height limiter for adjusting the height of the receiving area is provided so that the height of the receiving area can be adapted to the dimensions of the received notes of value.

2. Discussion

From the document DE 10 2012 102 223 A1, a cash box is known which comprises three height limiters and two side limiters, by means of which the receiving area of the cash box can be adapted to the dimensions of the notes of value to be received therein. One of the height limiters is arranged at the cover of the cash box. The other two height limiters are arranged laterally at the two corners of the receiving area which face the feeding opening for the automatic feeding and/or removing of notes of value and thus the retaining element.

By means of these two lateral height limiters it is achieved that the gap in the retaining element is always closed, and thus it is prevented that notes of value slip into this gap. These lateral height limiters, however, have the disadvantage that they make the automatic filling of the cash box more difficult since notes of value first have to be inserted laterally next to the lateral height limiters and then have to be moved under said limiters. During this displacement of the notes of value, there is the risk that individual notes of value which slightly project from the value note stack might be pulled under the other notes of value of the stack which may result in problems during the subsequent withdrawal operation.

SUMMARY OF THE INVENTION

It is an aspect of the invention to specify a cash box in which notes of value can automatically be fed in an easy manner.

According to the preferred embodiment of the invention, the height limiter comprises at least one finger which projects into a recess of the retaining element when the cover is closed.

By way of this design of the height limiter, it is achieved that only the one height limiter that is mounted to the cover is required and no further lateral height limiters are necessary. As the finger of the height limiter projects into the recess of the retaining element it is achieved that the gap to the retaining element is always closed. Thus, the height limiter of the cover fulfils the function that was fulfilled by the lateral height limiters in the known cash boxes of the prior art.

Due to the fact that only the height limiter mounted to the cover is provided and the lateral height limiters can be dispensed with, it is achieved that, when the cover is open, a value note stack can be fed in a straight line through the first opening without difficulty, and it is no longer necessary that this stack is moved laterally on the bottom unit. As only the one height limiter on the cover is provided, this limiter is completely removed when the cover is open and thus does not impede the feeding of notes of value to the receiving area.

By projecting of the height limiter into the recess it is meant that at least a partial area of the height limiter is arranged within the recess. In particular, the finger may also completely project through the recess.

In a particularly preferred embodiment, the height limiter has at least one further finger, this one, too, being arranged at least in part in a further recess of the retaining element when the cover is closed. In a further alternative embodiment also more than two fingers, for example three fingers, and correspondingly more recesses may be provided.

The more fingers are provided, the more reliable the gap at the upper end of the retaining element is closed so that no notes of value can slip through this gap.

In a particularly preferred embodiment, the two fingers and/or the two recesses are identically and/or mirror-symmetrically formed with respect to each other. It is likewise advantageous when the two fingers and/or the two recesses are arranged mirror-symmetrically with respect to a center plane of the cash box. In this way, a uniform structure of the cash box and a reliable retaining of the notes of value in the receiving area are achieved.

The features listed in the following for the one height limiter and the one recess of the retaining element can, in the embodiment with more than one finger, as well be used for the other fingers or the other recesses of the retaining element, accordingly.

The height limiter in particular serves to adapt the dimensions of the receiving area to the dimensions of the notes of value to be received so that these are tightly enclosed preferably on all sides during the handling of the cash box so that a slipping of the notes of value within the receiving area is prevented.

For this, the height limiter is in particular mounted to a cover such that the distance between the cover and the height limiter and thus the distance between the height limiter and the bottom unit of the cash box is variable. For this, the height limiter is connected to the cover of the cash box in particular via a correspondingly adjustable connecting mechanism.

This connecting mechanism can in particular be designed as a snap-in connection, wherein a plurality of different snap levels are provided so that the height limiter can be adapted accordingly.

In a preferred embodiment, in addition to the height limiter, also two lateral width limiters are provided, by means of which the width of the receiving area can be adapted to the corresponding width of the notes of value.

The height limiter is in particular the only height limiter of the cash box, i.e. that the cash box has no further height limiters, in particular no height limiters arranged laterally at the corners in the area of the retaining unit. Thus, a particularly simple structure is achieved. Further, it is thus guaranteed that no height limiter impedes the feeding of notes of value through the first opening.

Preferably, independent of whether the retaining element is arranged in the retaining or feeding position, the finger projects into the recess of the retaining element so that, independent of the position of the retaining element, no gap is formed between the height limiter and the retaining element and the notes of value can thus not slip out of the receiving area toward the cover.

Further, it is advantageous when the finger projects into the recess with a varying depth dependent on the distance of the height limiter to the cover. Dependent on the distance of the height limiter to the cover, it may in particular be the case that the finger, dependent on the position, is only arranged partly within the recess or even completely projects therethrough.

In particular, the recess is formed like an elongated hole.

The recess preferably comprises a through hole delimited by a wall. By means of the through hole it is guaranteed that the depth by which the finger projects into the recess can be varied without the risk that the finger strikes against a bottom of the recess.

The wall of the recess preferably has a cut-out toward the cover through which the finger can be moved when opening the cover. In this way, it is achieved that the finger can be guided out of the recess of the retaining element without difficulty when opening the cover so that the height limiter together with the cover is likewise removed from the receiving area when the cover is opened. The cut-out is in particular formed as a reduction of the wall so that the retaining element is formed correspondingly stable by a closed upper edge but nevertheless the finger can be guided upwards and out by way of the cut-out.

In a particularly preferred embodiment, the retaining element has a crank. By crank it is in particular meant that the retaining element has a first and a second planar area and a curved area arranged between the two planar areas. The first and the second planar area are arranged in different planes extending parallel to each other. In particular, that one planar area that is arranged closer to the cover and also closer to the axis of the retaining element is arranged offset toward the receiving area relative to the other planar area, as a result whereof it is guaranteed that even when the retaining element is arranged in the feeding position the finger still projects into the recess. If the upper planar area were not correspondingly offset to the front, the finger would no longer project into the recess when the retaining element is arranged in the feeding position so that a gap would exist through which notes of value could slip.

Further, it is advantageous when also a press-on unit of the cash box, which is arranged at the side of the receiving area opposite to the second opening and which biases notes of value toward the second opening, is correspondingly adapted to the modified form of the retaining element and thus in particular has a projection in its contact surface for contacting the value note stack, which projection is designed approximately complementarily to the second planar partial area. Thus it is achieved that always a reliable holding of the value note stack between the press-on unit and the retaining element is guaranteed.

In an alternative embodiment, the press-on unit may also only be as high as the planar area facing the box bottom so that the press-on unit reliably presses the notes of value against this planar area with sufficient force. This embodiment has the advantage that a projection on the press-on unit can be dispensed with and thus this press-on unit is constructed as simple as possible.

Further features and advantages of the invention result from the following description which explains the invention in more detail on the basis of embodiments together with the enclosed Figures.

DETAILED DESCRIPTION OF THE PREFERRED EMBODIMENTS

Figure 1:
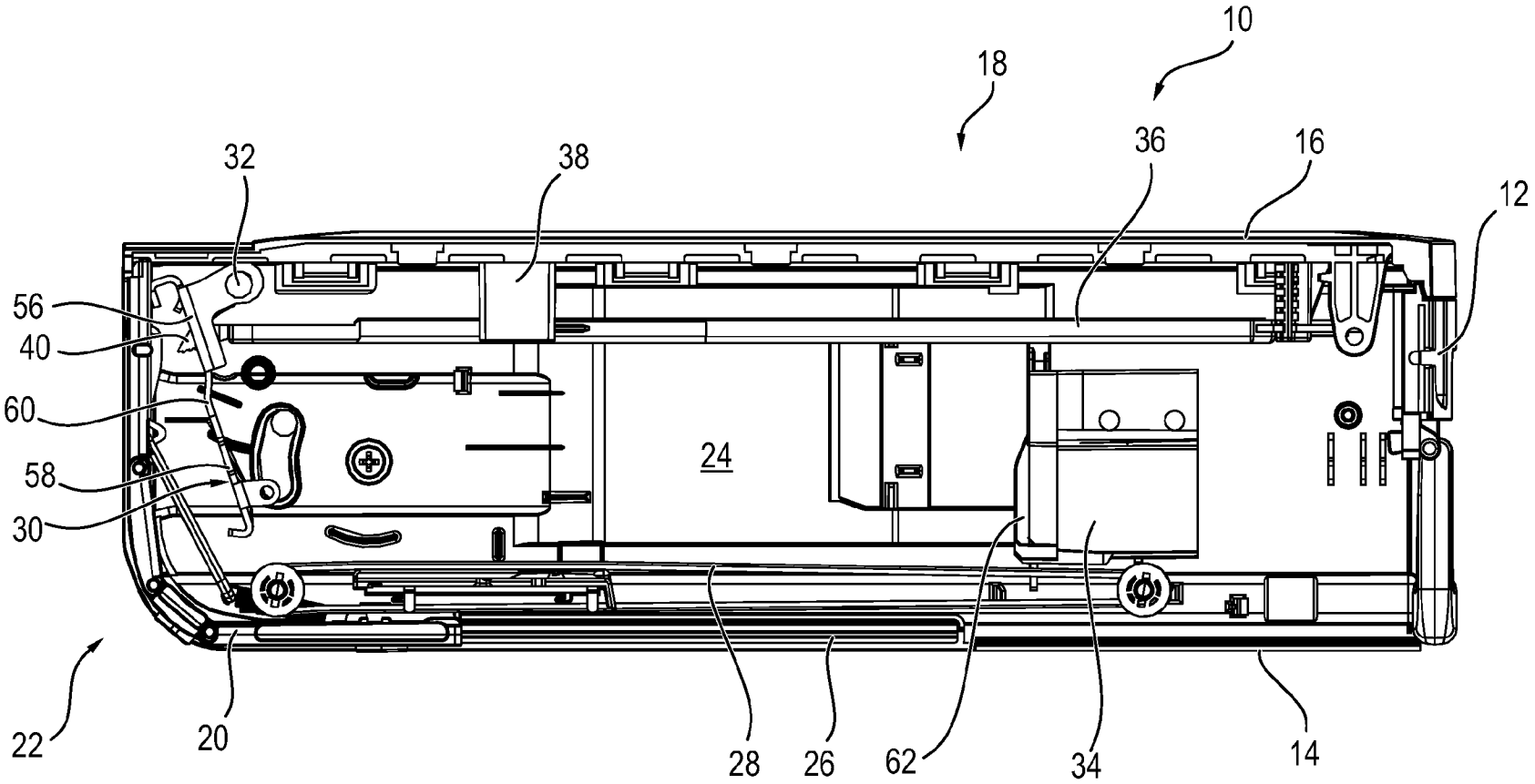
FIG. 1 shows a schematic illustration of a cash box according to a first embodiment with a retaining element arranged in a retaining position.

FIG. 1 is a schematic illustration of a cash box 10 according to a first embodiment, which comprises a housing 12 having a box bottom 14. The cash box 10 has a first opening 18 for manually feeding and/or removing notes of value, which first opening is closable by a cover 16, and a second opening 22 for automatically feeding of notes of value, which second opening is closable by a closing unit 20. The first opening 18 is in particular arranged at the top and the second opening 22 is arranged at one of the face sides of the cash box 10.

The receiving area 24 for receiving notes of value is delimited toward the box bottom 14 by a bottom unit 26 which in particular has several belts 28 on which the received notes of value stand on their edges.

Figure 2:
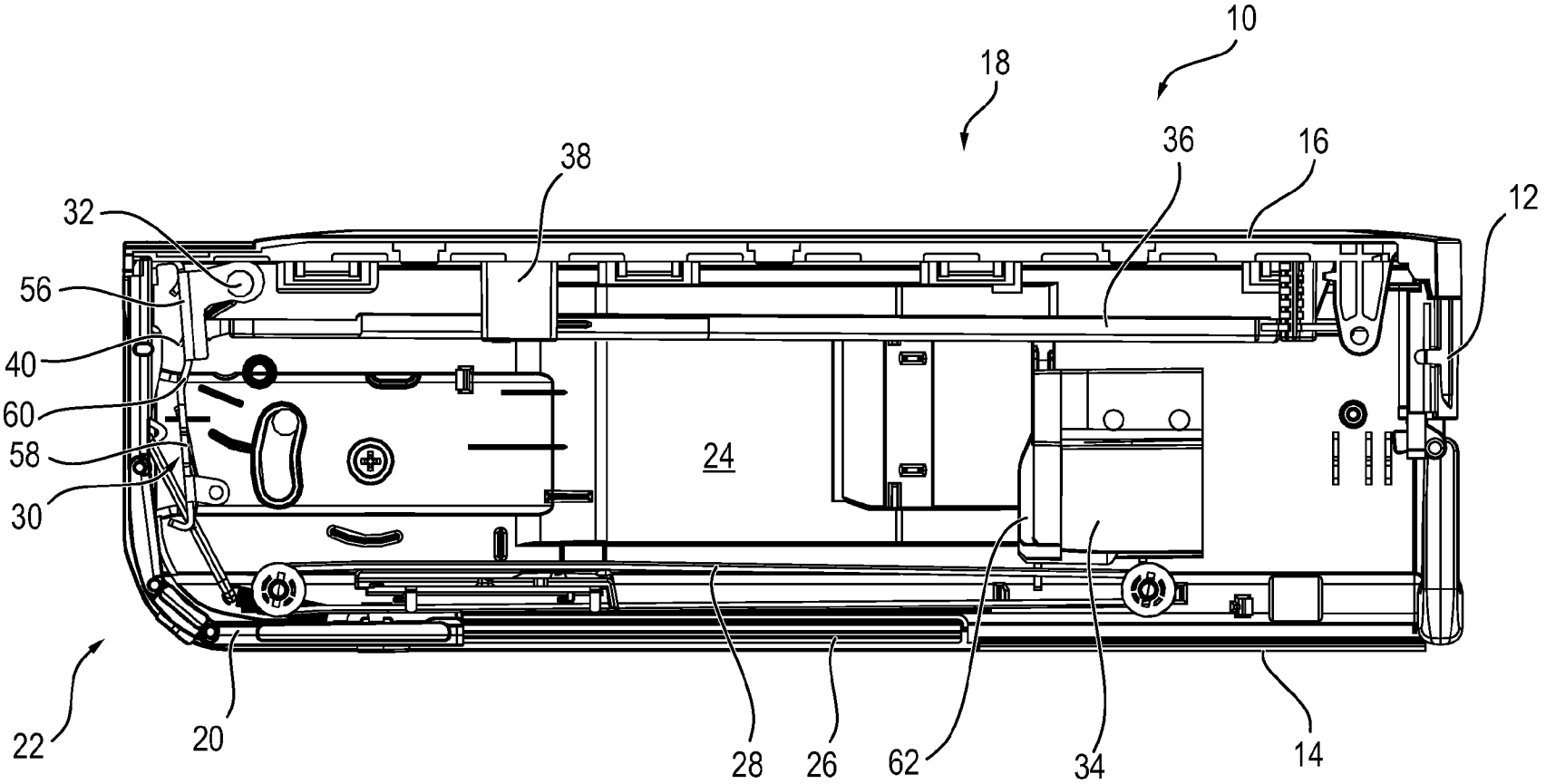
FIG. 2 shows a schematic illustration of the cash box according to FIG. 1 with the retaining element arranged in a feeding position.

Toward the second opening 22, the receiving area 24 is delimited by a retaining element 30 which is pivotable about an axis of rotation 32 between a retaining position shown in FIG. 1 and a feeding position shown in FIG. 2. In the retaining position, the retaining element 30 serves to retain the notes of value received in the receiving area 24 in said receiving area 24 so that these in particular cannot slip into the area between the receiving area 24 and the closing unit 20. In the feeding position, on the other hand, the retaining element 30 is pivoted so far that through the second opening 22 notes of value can be fed and/or removed, respectively, to and from the feeding area 24.

At the end opposite to the second opening 22, the receiving area 24 is delimited by a press-on unit 34 by which the notes of value received in the receiving area 24 are pressed toward the second opening 22 so that the notes of value of the value note stack arranged between the retaining element 30 and the press-on unit 34 are always kept under a minimum pressure so that the notes of value of the value note stack cannot fall over.

To the cover 16 of the cash box 10, a height limiter 36 is mounted by means of which the height of the receiving area 24 can be adjusted in that the distance between the height limiter 36 and the cover 16 and thus the distance between the height limiter 36 and the bottom unit 26 of the cash box 10 can be adjusted. For this, the height limiter 36 is connected to the cover 16 by means of a connecting mechanism 38 such that the distance between the height limiter 36 and the cover 16 is variable. In particular, a snap mechanism is provided, by means of which the distance can be varied in predetermined steps. The adjustment of the height limiter 36 in particular takes place manually when the configuration of the cash box 10 is defined, i.e. when it is defined which notes of value of which denomination are to be received in the cash box 10.

In particular, the height limiter 36 is always adjusted such that the height of the receiving area 24 approximately corresponds to the height of the notes of value to be received so that no or only a minimum distance exists between the notes of value standing on the bottom unit 26 and the height limiter 36 so that the notes of value cannot slip within the receiving area 24.

To guarantee a safe reception of the notes of value in the receiving area 24, it is necessary that no gap is formed between the height limiter 36 and the retaining element 30 as otherwise notes of value could slip therethrough. In particular, both in the feeding position and in the retaining position no gap must be formed.

Figure 3:
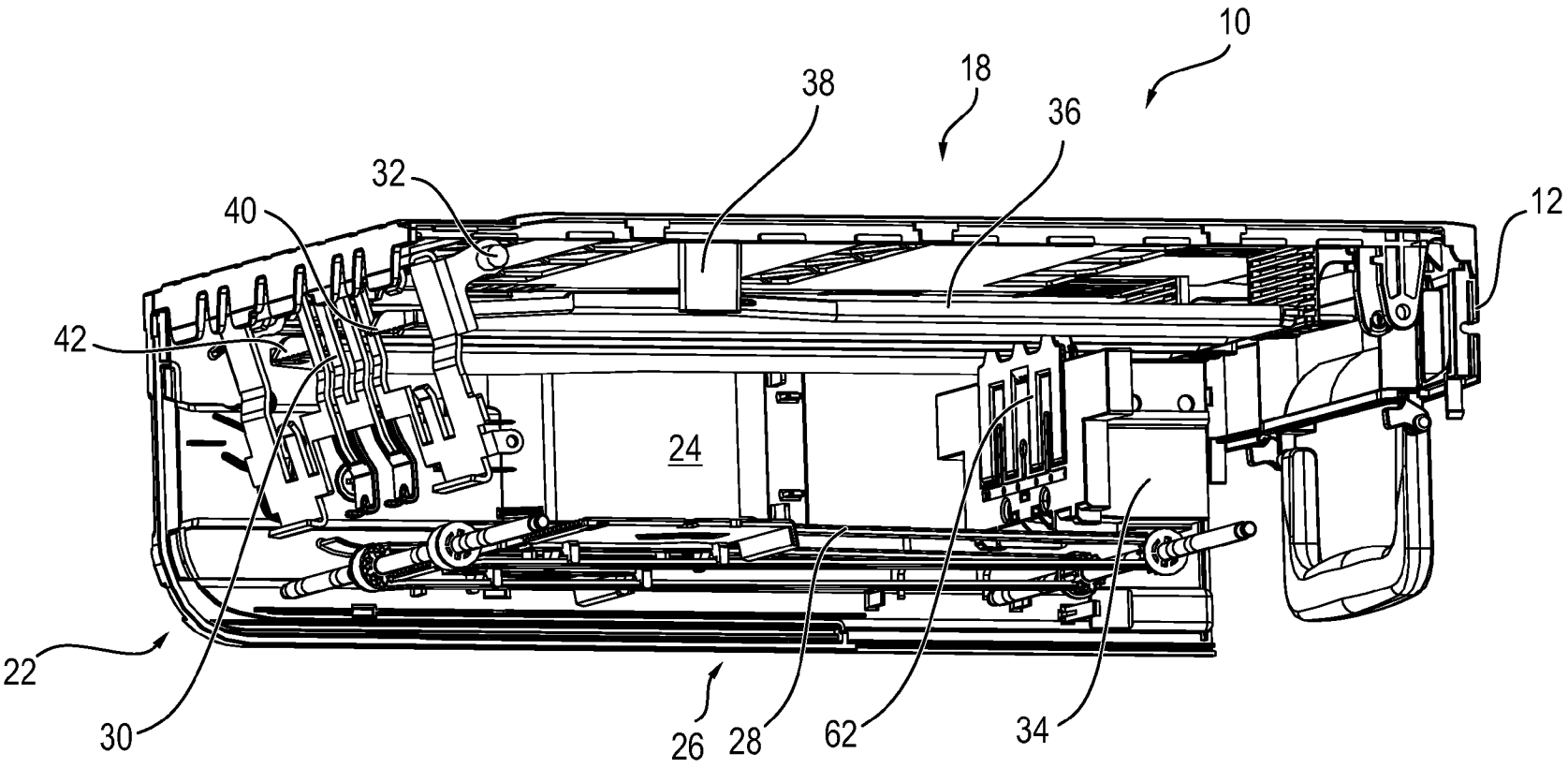
FIG. 3 shows a detail of the cash box according to FIGS. 1 and 2.
Figure 4:
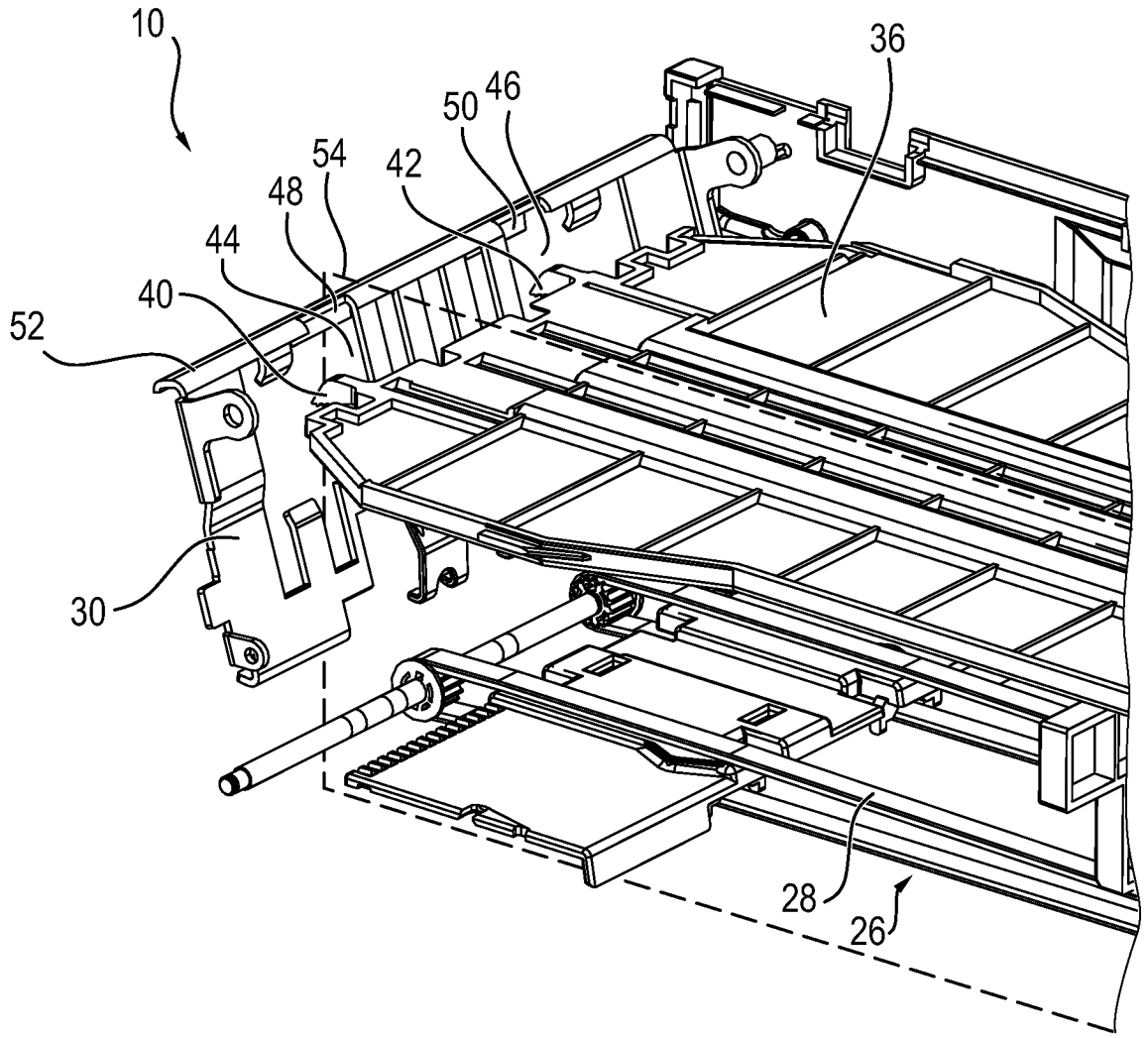
FIG. 4 shows a further detail of the cash box according to FIGS. 1 and 2.

To achieve this, the height limiter 36 as shown in FIGS. 3 and 4, has two fingers 40, 42 which project into recesses 44, 46 of the retaining element 30. Here, the shape of the retaining element 30 and of the fingers 40, 42 is adapted such that, independent of the position in which the height limiter 30 is arranged and the position in which the retaining element 30 is arranged, the finger 40, 42 is always arranged at least in part within the recess 44, 46 so that no gap is formed.

By providing such fingers 40, 42, which, independent of the position, always project into the recesses 44, 46, it is achieved that no further height limiters are necessary but only the height limiter 36 present on the cover 36 has to be provided.

By mounting the height limiter 36 to the cover 16 it is achieved that the height limiter is moved together with the cover when the cover 16 is opened, and thus during the manual feeding of notes of value through the first opening 18 it does not impede this feeding. In particular, thus notes of value can be fed upright from above in the entire receiving area 24 and do not have to be moved under any height limiters toward the retaining element 30 when they already stand on the bottom unit 26. Thus, the risk is prevented that notes of value projecting from the value note stack are pulled under the other notes of value of this value note stack via the friction to the bottom unit 26 and thus could cause problems during the later automatic removal of notes of value from the second opening 22.

The recesses 44, 46 are each formed as through holes so that the fingers 40, 42, depending on the distance in which the height limiter 36 is arranged to the bottom unit 26, can project into or through these recesses 44,46 with a varying depth. In an alternative embodiment, the recesses 44, 46 may also not be formed as through holes but merely as depressions within a closed surface.

In the upper area, i.e. the area facing the cover 16, the recesses 44, 46 each have a cut-out 48, 50 by means of which it is achieved that the fingers 40, 42 can be passed through during the opening of the cover 16 so that the height limiter 36 together with the cover 16 can be removed without difficulty.

In an alternative embodiment of the invention, also no cut-outs 48, 50 may be provided but the recesses 44, 46 can be open to the top in that the upper partial area 52 of the retaining element 30 is interrupted at the corresponding areas, accordingly.

In an alternative embodiment of the invention, also only one finger 40, 42 can be provided. Likewise, it is alternatively possible that more than two fingers 40, 42 are provided which correspondingly project into more than two recesses 44, 46. The fingers 40, 42 and the recesses 44, 46 are in particular arranged mirror-symmetrically with respect to a center plane 54 of the cash box 10 and are preferably identically formed. Thus, a uniform structure is achieved.

The retaining element 30 is in particular formed in a cranked manner, i.e. that the retaining element comprises a first planar area 56, a second planar area 58 and a curved area 60 arranged between these two planar areas. The two planar areas 56, 58 are, as can be taken well from FIG. 2, arranged in offset planes extending in parallel.

By way of this cranked embodiment it is achieved that, as shown in FIG. 2, the fingers 40, 42 of the height limiter 36 project into the recesses 44, 46 of the retaining element 30 even when said retaining element is arranged in the feeding position since the first planar area 56 is arranged offset further into the inside of the box, i.e. further toward the receiving area 24 relative to the second planar area 58.

In particular in that one area which is arranged opposite to the second planar area 58 the press-on unit 34 has a projection 62 which in particular has the same thickness as the offset of the two planar areas 56, 58 to each other. By means of this projection 62, it is achieved that the notes of value are always reliably received uniformly between the retaining element 30 and the press-on carriage 34.

Figure 5:
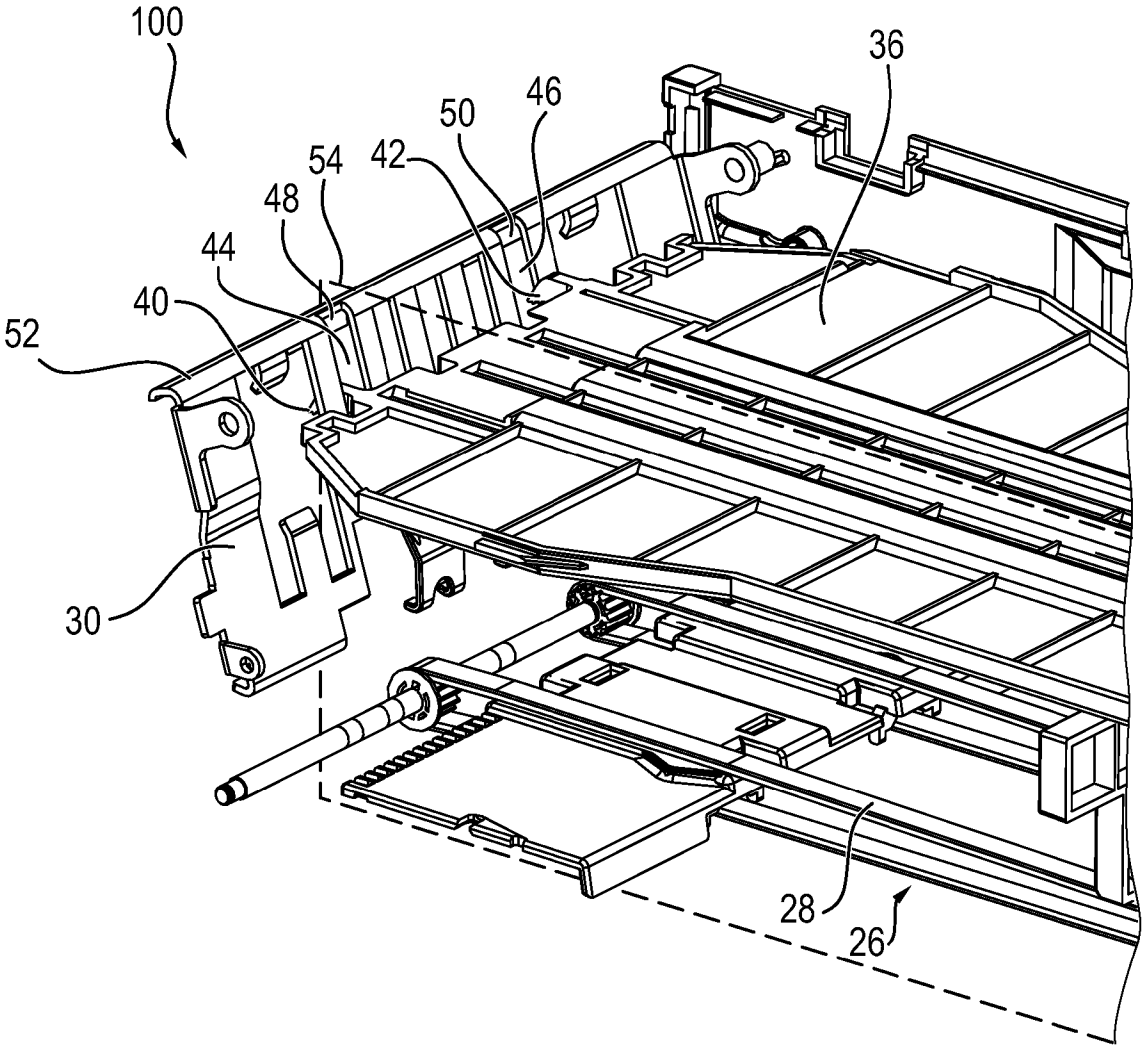
FIG. 5 shows a schematic illustration of a cash box according to a second embodiment.

FIG. 5 shows a cash box 100 according to a second embodiment. The cash box 100 differs from the cash box 10 according to the first embodiment in that the recesses 44, 46 are each formed as an elongated hole, as a result whereof a more stable structure of the retaining element 30 is achieved.

Figure 6:
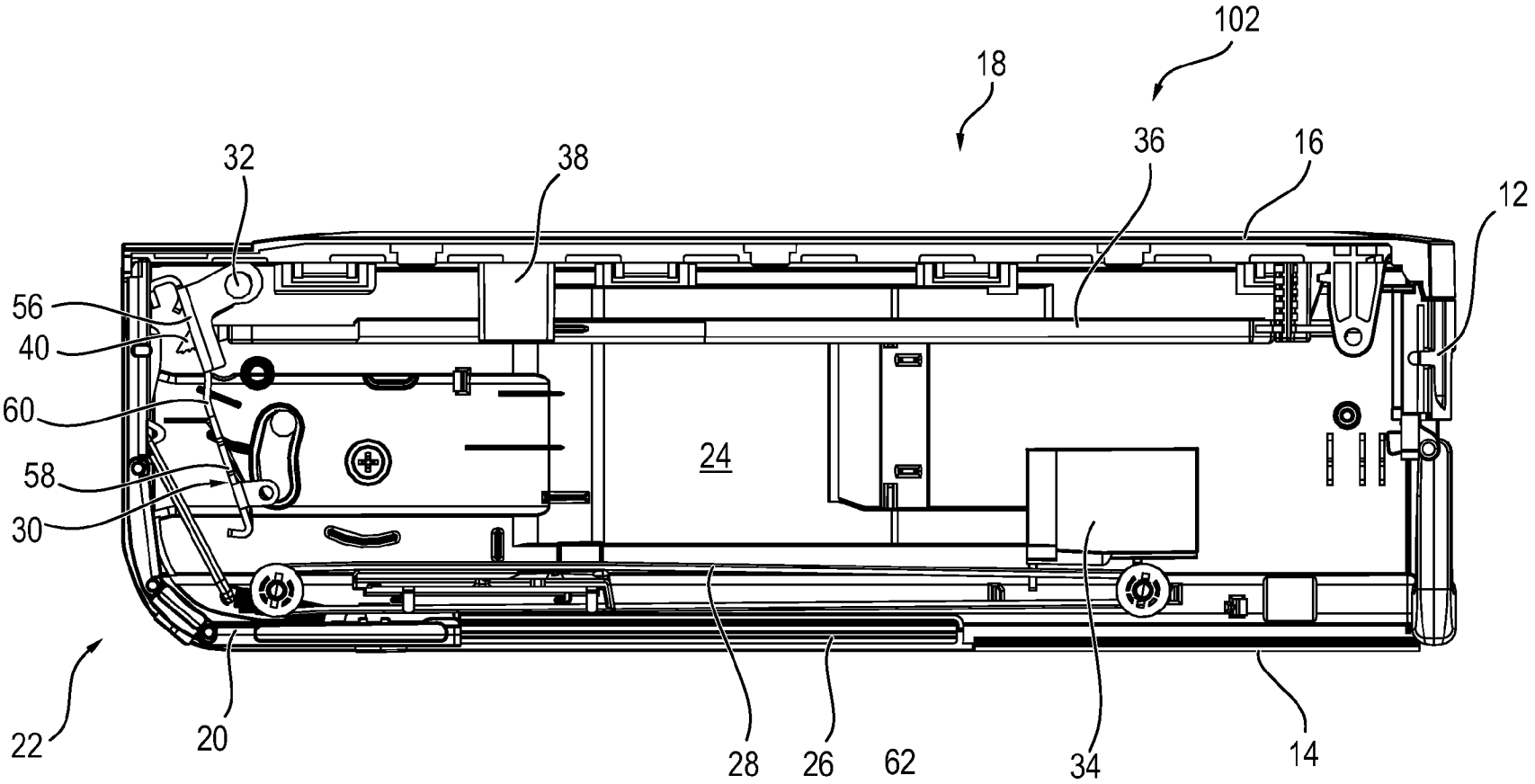
FIG. 6 shows a schematic illustration of a cash box according to a third embodiment.

FIG. 6 shows a cash box 102 according to a third embodiment. The cash box 102 differs from the cash box 10 according to the first embodiment in that the press-on unit 34 is formed only as high as the lower planar area 58. This has the advantage that the contact surface of the press-on unit 34 via which it contacts the notes of value can be formed as a smooth, simple surface. In particular, no projection has to be provided.

What is claimed is:

1. A cash box, comprising a receiving area for receiving a value note stack, a first opening for manually feeding and/or removing notes of value to and from the receiving area, respectively, which first opening is closable by a cover, a bottom unit delimiting the receiving area toward a box bottom, a retaining element which, in a retaining position, retains the notes of value received in the receiving area in said receiving area and which, in a feeding position, enables a feeding and/or removing of the notes of value through a second opening for automatically feeding and/or removing notes of value, and a height limiter for adjusting the height of the receiving area, which height limiter is mounted to the cover, wherein the height limiter includes at least one finger, and wherein the retaining element has at least one recess into which the finger of the height limiter projects when the cover is closed.

2. The cash box according to claim 1, wherein the height limiter comprises at least a second finger, and that the retaining element has at least a second recess, into which the second finger of the height limiter projects when the cover is closed.

3. The cash box according to claim 2, wherein the two fingers and the two recesses are identically formed.

4. The cash box according to claim 2, wherein the two fingers and the two recesses are arranged mirror-symmetrically with respect to a center plane of the cash box.

5. The cash box according to claim 1 wherein the height limiter is mounted to the cover such that the distance between the cover and the height limiter is variable.

6. The cash box according to claim 5, wherein the height limiter is mounted adjustably to the cover via a snap-in connection.

7. The cash box according to claim 1 wherein the height limiter mounted to the cover is the only height limiter of the cash box.

8. The cash box according to claim 1 wherein the finger projects into the recess of the retaining element both when the retaining element is arranged in the retaining position and in the feeding position.

9. The cash box according to claim 1 wherein the finger projects with varying depth into or through the recess dependent on the distance of the height limiter to the cover.

10. The cash box according to claim 1 wherein the recess comprises a through hole delimited by a wall, and that the wall has a cut-out toward the cover through which the finger can be moved when the cover is opened.

11. The cash box according to claim 10, wherein the cut-out is formed as a reduction of the wall.

12. The cash box according to claim 1 wherein the retaining element has a crank.

13. The cash box according to claim 1 wherein the retaining element has a first planar area, a second planar area and a curved area arranged between the planar areas, and that the first and the second planar area are arranged in different planes extending parallel to each other.

14. The cash box according to claim 12 wherein the cash box comprises a press-on unit for pressing a value note stack received in the receiving area toward the second opening, and that the press-on unit has a projection.

15. The cash box according to claim 13, wherein the cash box comprises a press-on unit for pressing a value note stack received in the receiving area toward the second opening and that the press-on unit is only as high as the second planar area.

* * * * *